United States Patent [19]

Bailey, deceased

[11] Patent Number: 4,458,833

[45] Date of Patent: Jul. 10, 1984

[54] CASKS AND LIKE CONTAINERS

[75] Inventor: Victor S. Bailey, deceased, late of Teddington, England, by Jean Bailey, administratrix

[73] Assignee: Grundy (Teddington) Limited, Middlesex, England

[21] Appl. No.: 377,674

[22] Filed: May 12, 1982

Related U.S. Application Data

[63] Continuation-in-part of Ser. No. 120,789, Feb. 12, 1980, Pat. No. 4,368,831.

[51] Int. Cl.[3] ..... B67D 1/04

[52] U.S. Cl. ..... 222/400.7; 137/212

[58] Field of Search ..... 222/400.7, 400.8; 137/212

[56] References Cited

U.S. PATENT DOCUMENTS

| | | | |
|---|---|---|---|
| 2,157,966 | 5/1939 | Reisinger et al. | 222/400.7 |
| 3,036,586 | 5/1962 | Reeve | 222/400.7 X |
| 4,180,189 | 12/1979 | Zurit et al. | 222/400.7 |

FOREIGN PATENT DOCUMENTS

| | | | |
|---|---|---|---|
| 7704708 | 10/1978 | Netherlands | 222/400.7 |
| 7806760 | 12/1979 | Netherlands | 222/400.7 |
| 1423796 | 2/1976 | United Kingdom | 137/212 |

*Primary Examiner*—Joseph J. Rolla
*Assistant Examiner*—Frederick R. Handren
*Attorney, Agent, or Firm*—Emory L. Groff, Jr.

[57] ABSTRACT

A cask or container for dispensing liquid under pressure is of the type having a top housing with a bung hole therein and an extractor tube extending into the container and in which a top fitting is attached to the housing with means operative thereon to bring a gas introduction passage into communication with one part of the housing and a beverage outlet passage in to communication with the top of the extractor tube. The arrangement of the invention is such that pilferage from the container is reduced, achieved by welding the housing directly to the cask and arranging for the extractor tube to be withdrawn through the top of the housing with a sealing means arranged so that it can be upset and removed. The opening in the top of the housing is arranged to permit passage of the sealing means and extractor tube which is threadably engaged by a lower part of the housing for extraction by means of a special tool.

4 Claims, 3 Drawing Figures

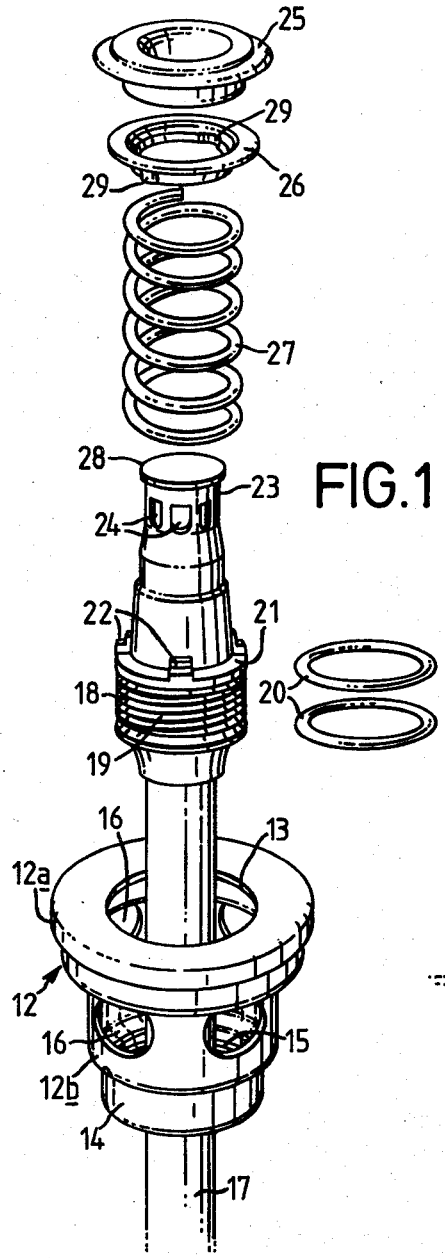
FIG.1
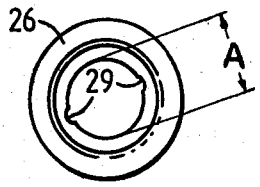
FIG.3
FIG. 2
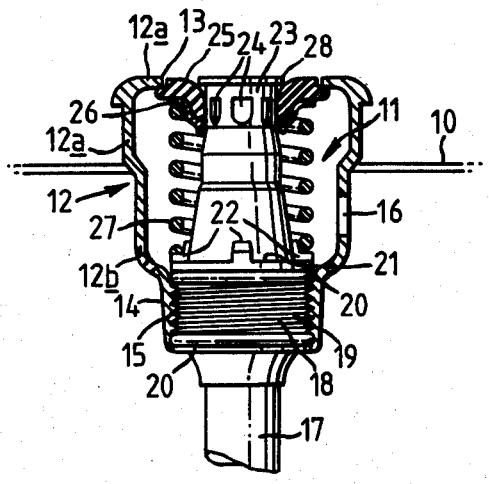

CASKS AND LIKE CONTAINERS

This application is a continuation-in-part of application Ser. No. 120,789 filed Feb. 12, 1980, now U.S. Pat. No. 4,368,831.

FIELD OF THE INVENTION

This invention relates to a cask or container for liquid under pressure, and is of the type in which the bung hole has a spring loaded ring seal within a collar around the bung hole, there being an extractor tube extending downwardly to near the bottom of the container this tube having a head the top of which is substantially co-planar with the top surface of the ring seal and located therein so that before broaching the seal forms a closure between a seating of the collar and head, the cask being broached by securing a dispensing head on to the collar, and moving a plunger in the dispensing head to depress the seal, this action also putting an outlet from the extractor head in communication with a liquid outlet through the dispenser head, and applying also through the head, gas under pressure on to the surface of the liquid to dispense same.

BRIEF DESCRIPTION OF PRIOR ART

With casks as above it is customary to secure a collar to the top wall of the cask so as to upstand around the bung hole in which collar a metal insert engages, this insert being internally screw threaded to receive a closure fitting which fitting carries the ring seal and extractor tube.

In the known art as exemplified in U.S. Pat. No. 4,180,189 and Dutch Patent No. 7806760, the housing which carries the extractor tube is engaged complete with the tube into the wall of the container by a screw thread with a suitably interposed sealing ring. A disadvantage with such a coupling is that it is relatively easily unscrewed and the contents can be pilfered or contaminated. It is thus possible to remove part of the contents and top-up with another liquid and thereafter replace the screwed top without detection and using a standard wrench or other tool. It will be appreciated that the extractor tube must be removable for cleaning or replacement purposes as it is a part of the container which becomes damaged through normal usage and the rubber seals require frequent replacement. It is also possible for the housing to be only partially screwed into the container or for the threads to be damaged whereupon the housing is likely to be blown out on pressurization creating a safety hazard in the place of use.

This invention therefore seeks to provide a container with a housing which cannot be easily removed so as to prevent pilfering of the contents but which nevertheless still allows the extractor tube and seals to be replaced in a quick and easy manner when required.

OBJECTS OF THE INVENTION

It is therefore a first object of this invention to provide a simplified housing construction on a container for mounting the seal and extractor tube whereby cleaning is easily effected.

A further object is to provide a housing which is itself firmly connected with the container to reduce the likelihood of same being detached through damage and to prevent removal and pilfering of the contents.

Yet a further object is to provide a construction wherein the number of components and the manufacturing costs thereof are substantially reduced and wherein the mechanical operation is much simplified thus considerably reducing the risk of failure of the seals and operative parts through repeated attachment and detachment of the top fitting.

SUMMARY OF THE INVENTION

Accordingly all these objects may be achieved by a construction of cask according to the invention which provides a cask for pressurised liquid said cask having a housing nonremovably secured to the top wall of the cask at a bung hole outlet to upstand therearound, said housing comprising an integral skirt depending into the cask and an integral body upstanding from the cask, said body having a flange forming a coupling member to engage a liquid dispensing head, said skirt having an inturned flange at its lower end, a liquid extractor tube extending from the bottom of the cask to the top and up into the housing, a brush secured to said extractor tube and connecting said tube to said inturned flange, the diameter of the bush around the extractor tube being of less diameter than the diameter of an aperture in the upper end of said body of the housing thereby enabling the extractor tube to be withdrawn through the upper end of said body, said extractor tube including a head portion located with said housing above said bush, a resilient ring seal with a supporting cup washer and loading spring located in said housing and positioned around said extractor tube, a seat within and located around the aperture in the upper end of the body of said housing, an outer peripheral part of said seal engaging said seat, the top end of said extractor tube head being embraced by said ring seal, said spring urging said ring seal into engagement with the seat and tube head, the cup washer having an external diameter less than the diameter of the aperture in the upper end of the housing so that same may pass therethrough and an internal diameter less than the diameter of a flange portion forming the seal at the top end of the extractor tube head, the internal diameter of the cup washer having an enlarged dimension across a diameter in one direction whereby through tilting of the cup washer relative to the top of the extractor tube head the flange thereon may pass through the increased diameter portion to enable the cup washer to be removed from the extractor tube head and through the housing.

As compared with known art the housing assembly can be made compatible with the known kinds of head fittings and for such reason the fittings are not described or disclosed in this specification as they form no part of the inventive concept. The housing is preferably secured to the container by welding forming a pressure-proof and non-removable connection.

It is preferred for the connection between the bush and flange to be a screw threaded one and sealing rings may be provided around the bush at each end of the threading forming a sealing means.

The arrangement of the invention provides that the cup washer normally has an internal diameter less than the flange on the head of the tube whereby internal pressure cannot force same outwards so long as it remains in a plane perpendicular to the axis of the extractor tube. In such a position there is therefore little risk of the ring seal and cup washer being blown out of the container through excess pressure. Nevertheless, following removal of the ring seal by depressing the seal and washer against the spring, it is possible to allow the cup washer to cant whereby the flange on the head of the extractor tube can pass at an oblique angle through the enlarged portion enabling the cup washer and thus spring to be removed. Following this operation and by using a suitable tool the extractor tube can be unscrewed from the housing and removed for cleaning and filling the container.

It will be appreciated from the foregoing that the housing itself cannot be unscrewed and even if the ring seal and cup washer is removed then a special tool is required to remove the extractor tube. Thus removal of any substantial quantity of the contents of the container and its replacement with a diluent is impossible, or at least extremely difficult and time consuming.

In a preferred embodiment of the invention the bush of the extractor tube has an upper planar surface with a number of upstanding dogs thereon which can be engaged by a box spanner-like tool having complementary projections. In an alternative embodiment an extractor tool is provided which engages formations or apertures at the upper end of the extractor tube, but it will be appreciated that many forms of engagement can be provided to defeat the use of standard tools to remove the extractor tube.

A further advantage offerred by the invention is the substantial dimension of the bush on the extractor tube which engages the flange on the housing and this preferably incorporates two spaced O-rings which form a liquid and gas seal. This provides a strong connection in contrast with known art wherein a relatively weak weld or pressed connection is formed between the top housing and extractor tube. Again, this feature prevents damage and unauthorized broaching of the container.

BRIEF DESCRIPTION OF THE DRAWING

The accompanying drawings show one form of practical embodiment of the invention and in the drawings:

FIG. 1 shows an exploded view of the housing only with the extractor tube and associated components which form part of this invention, FIG. 2 shows in cross-section the housing and extractor tube in FIG. 1 installed in the top part of a beverage container, and FIG. 3 is a plan view of the cup washer in the head of the housing.

DESCRIPTION OF PREFERRED EMBODIMENT

Referring to the drawings, the top wall part of a container is referenced 10, and for simplicity the remainder of the container is not shown. This will be of standard size and construction and does not form part of this invention. The top wall of the container incorporates an aperture or socalled bung hole 11 and welded within this bung hole is a housing 12 of which one part **12*a* projects above the container wall 10 and the other part 12*b* projects below. The upper surface of the top part of the housing 12*a* is planar and has therein an aperture 13. The lower half of the housing 12*b* has a depending skirt portion 14 which is provided internally with a screw threading 15. The lower part of the housing includes apertures 16 through which pressurized gas may pass from a top fitting through the housing and into the container thereby to force beverage up the centrally disposed extractor tube 17. The extractor tube 17 at its upper end is positively connected with a bush 18 having an external threading 19 complementary with and engaging the threading 15 on the skirt. Disposed at each end of the threading 19 are rubber O-rings 20 which form a gas and liquid tight seal between the collar 18 and flange portion 14** of the housing.

The upper part of the collar 18 has a planar portion 21 with a number of upstanding dogs 22 thereon for engagement with a removal tool. The diameter of the collar 18, and in particular the upper portion 21, is just less than the diameter of the aperture 13 in the top part of the housing whereby by means of a suitable tool engaging the dogs 22 the extractor tube and collar may be unscrewed and thereafter removed upwardly through the housing and out of the container. The head 23 of the extractor tube includes therein a number of apertures 24 through which beverage issues to pass into the top fitting (not shown). Operatively associated with the head of the extractor tube is a rubber ring seal 25 which on its inner periphery sealingly engages the head 23 to close off the ports 24, and on its outer periphery engages a seat defined by the inner edge of the aperture 13. The top fitting when connected and operated depresses the ring seal thereby opening the ports 24 for external communication with a dispensing duct. As is known, simultaneously with this action a gas introduction passage is connected with the housing to allow pressurizing gas to pass through the apertures 16 in the lower portion **12*b*** thereof.

To retain the seal 25 in position a cup seat 26 is provided and this seat is profiled to conform with the lower profile of the seal 25 and forms a bearing support. The underside of the cup seat 26 is subject to pressure from a spring 27 which bears against the collar portion 21 to normally urge the seal 25 into engagement with a flange 28, provided on the top of the extractor tube, and the sealing surface in the aperture 13.

The actual way in which the coupling head cooperates with the housing and associated parts is well known and illustrated in FIGS. 1 and 2 of Dutch Pat. No. 7704708 as one convenient example.

To achieve the various objects of this invention it is necessary to provide for relatively simple removal by authorized personnel of the extractor tube and accordingly this is achieved by a construction of cup seat 26 which has a diameter across A which is less than the flange 28 on the head of the extractor tube, so that when the cup seat lies in a plane normal to the axis of the tube it would abut the flange and cannot be forced off by the spring. The outer diameter of the cup seat 26 is slightly less than the aperture 13 in the top of the housing so that it may pass therethrough. To enable cup seat to be removed the internal diameter embodies a portion of increased dimension and this may be achieved by forming the aperture as an oval or providing two suitable relieved portions 29 therein whereby canting of the washer can be carried out to bring the portions 29 into engagement with the flanged head enabling the cup seat to be progressively canted to the vertical position and moved across the head and finally out of the housing. It will be understood that before this operation is carried out the seal 25 has been previously removed, which in itself is a relatively simple operation due to its resiliency. The spring 27 is thus released and this enables a suitable tool to be then engaged with the dogs 22 so that the extractor tube can be inscrewed and thereafter removed.

The fact that the extractor tube assembly is screwed into the integrated housing and subsequently covered or sealed in by the spring seating washer and the seal ensures that unauthorized removal of the extractor tube assembly or tampering with the whole extractor tube assembly to remove the contents is minimised. In fact, without removing the main seal, for which a special tool is required, access to the interior is extremely difficult and the contents can only be removed at a very slow rate, this being of some considerable advantage in transporting full containers. The assembly and the method by which the main seal adds to the security of the contents is illustrated in the drawing depicting a cross-section of the assembly and an exploded view of the components.

Referring again to the drawing, it can be seen that the extractor tube assembly is screwed firmly into the integrated housing of the container and cannot easily be ejected by high pressures generated inside the container.

The method of assembling the spring seating washer and the seal onto the extractor tube assembly, when the latter is screwed into the housing, can only be effected if the internal diameter of the spring seating washer is larger that the head of the extractor tube. It follows that if the inside diameter of the spring seating washer was generally larger than the diameter of the flange 28, as soon as it was pressed onto the spring, it would lift up again. In order to assemble the spring seating washer onto the head of the extractor tube the hole is oval. This feature has a two fold advantage in that the spring seating washer can be clipped over the flange diameter and it will remain in place together with the feature that when the seal is removed, the spring seating washer again remains in place, as the oval aspect of the washer retains it in place.

Another aspect of the design which is an improvement to existing designs is that the spring is located onto four raised dogs. The fact that the spring is raised off of the main screwed body allows for improvements to the washing of the inside of the spring, this being undertaken by hot water sprayed into the container. This is an improvement on a sterility basis to existing designs.

Although the disclosure herein shows the interior of the cup seat 26 as being of generally oval shape or having two diammetrically opposed cut-away portions, other configurations are possible within the context of this invention and suitable relieved parts or other forms of ovaloid shape can be provided whilst still achieving the same objects.

I CLAIM:

1. A cask for pressurised liquid said cask having a housing non-removably secured to the top wall of the cask at a bung hole outlet to upstand therearound, said housing comprising an integral skirt depending into the cask and an integral body upstanding from the cask, said body having a flange forming a coupling member to engage a liquid dispensing head, said skirt having an inturned flange at its lower end, a liquid extractor tube extending from the bottom of the cask to the top and up into the housing, a bush secured to said extractor tube and connecting said tube to said inturned flange, the diameter of the bush around the extractor tube being of less diameter than the diameter of an aperture in the upper end of said body of the housing thereby enabling the extractor tube to be withdrawn through the upper end of said body, said extractor tube including a head portion located in said housing above said bush, a resilient ring seal with a supporting cup washer and loading spring located in said housing and positioned around said extractor tube, a seat within and located around the aperture in the upper end of the body of said housing, an outer peripheral part of said seal engaging said seat, the top end of said extractor tube head being embraced by said ring seal, said spring urging said ring seal into engagement with the seat and tube head, the cup washer having an external diameter less than the diameter of the aperture in the upper end of the housing so that same may pass therethrough and an internal diameter less than the diameter of a flange portion forming the seal at the top end of the extractor tube head, the internal diameter of the cup washer having an enlarged dimension across a diameter whereby through tilting of the cup washer relative to the top of the extractor tube head the flange thereon may pass through the increased diameter portion to enable the cup washer to be removed from the extractor tube head and through the housing.

2. A cask for pressurized liquid as claimed in claim 1, wherein the upper surface of the bush includes dogs for engagement with an extractor tool applied through the aperture in the housing, the bush around the extractor tube including two spaced O-rings forming a seal when engaged with the lower part of the housing.

3. A cask for pressurized liquid as claimed in claim 2, wherein the base of the spring locates and seats on formations provided on the upper surface of the dogs on the collar to space same from the collar surface.

4. A cask for pressurized liquid as claimed in claim 1, wherein the bush on the extractor tube has an external threading engaging a complementary threading on the inside of the flange of the housing.

* * * * *